US011976578B2

(12) United States Patent
Chui

(10) Patent No.: US 11,976,578 B2
(45) Date of Patent: May 7, 2024

(54) DRIVING DEVICES FOR A COMPOSITE ENGINE VALVE OF A DEDICATED DRIVING CAM

(71) Applicant: JIANGSU JOINTEK PRECISION MACHINERY CO., LTD., Jiangsu (CN)

(72) Inventor: Lap Lam Chui, Changzhou (CN)

(73) Assignee: JIANGSU JOINTEK PRECISION MACHINERY CO., LTD., Changzhou (CN)

( * ) Notice: Subject to any disclaimer, the term of this patent is extended or adjusted under 35 U.S.C. 154(b) by 0 days.

(21) Appl. No.: 18/487,033

(22) Filed: Oct. 13, 2023

(65) Prior Publication Data

US 2024/0044268 A1 Feb. 8, 2024

Related U.S. Application Data

(63) Continuation of application No. PCT/CN2022/089477, filed on Apr. 27, 2022.

(30) Foreign Application Priority Data

Nov. 25, 2021 (CN) ..... 202111411311.3

(51) Int. Cl.
*F01L 9/14* (2021.01)
*F01L 1/047* (2006.01)
(Continued)

(52) U.S. Cl.
CPC ..... *F01L 9/14* (2021.01); *F01L 1/047* (2013.01); *F01L 1/181* (2013.01); *F01L 1/267* (2013.01); *F01L 1/46* (2013.01); *F01L 13/06* (2013.01)

(58) Field of Classification Search
CPC ... F01L 1/181; F01L 1/267; F01L 1/46; F01L 9/14; F01L 13/06
(Continued)

(56) References Cited

U.S. PATENT DOCUMENTS 5,680,841 A 10/1997 Hu
6,253,730 B1 7/2001 Gustafson
(Continued)

FOREIGN PATENT DOCUMENTS

CN 102787880 A 11/2012
CN 204098976 U 1/2015
(Continued)

OTHER PUBLICATIONS

International Search Report in PCT/CN2022/089477 dated Aug. 23, 2022, 7 pages.
(Continued)

*Primary Examiner* — Jorge L Leon, Jr.
(74) *Attorney, Agent, or Firm* — Porus IP LLC

(57) ABSTRACT

The present disclosure provide a driving device for a composite engine valve of a dedicated driving cam. The driving device includes a valve bridge, a dedicated driving cam, a driver, and a driving oil circuit. The driving oil circuit is configured to be intermittently in communication with a main piston hole and an auxiliary piston hole through a closure and disconnection of the driving oil circuit. The driver is fixedly mounted on a rocker arm shaft, which is simple in structure and low in cost. No motion friction between the driver and the rocker arm shaft, and the dedicated driving cam separating from the main piston when the driver is not in operation effectively reduce wear and noise between the dedicated driving cam and the main piston and improve engine power utilization. When the driver is in operation, the dedicated driving cam automatically adjusts a
(Continued)

driving valve through a hydraulic gap, and a driving lift is not affected by an initial gap setting. The driving oil circuit is automatically drained once per revolution of a positive power cam, thus, a circulating flow of oil may not cause accumulation of impurities when the oil is too dirty, which improves working stability and reliability.

9 Claims, 9 Drawing Sheets

(51) Int. Cl.

| | |
|---|---|
| ***F01L 1/18*** | (2006.01) |
| ***F01L 1/26*** | (2006.01) |
| ***F01L 1/46*** | (2006.01) |
| *F01L 13/06* | (2006.01) |

(58) Field of Classification Search
USPC ..... 123/90.12, 90.16, 90.4, 90.44
See application file for complete search history.

(56) References Cited

U.S. PATENT DOCUMENTS

| | | | | |
|---|---|---|---|---|
| 6,386,160 | B1 | 5/2002 | Meneely et al. | |
| 9,347,383 | B2 * | 5/2016 | Janak | F02D 13/0203 |
| 2009/0199796 | A1 | 8/2009 | Hisada et al. | |

FOREIGN PATENT DOCUMENTS

| | | | | | |
|---|---|---|---|---|---|
| CN | 105507974 | A | | 4/2016 | |
| CN | 107060941 | A | | 8/2017 | |
| CN | 112177702 | A | * | 1/2021 | F01L 1/053 |
| CN | 112177702 | A | | 1/2021 | |
| CN | 112177703 | A | | 1/2021 | |
| CN | 113818943 | A | | 12/2021 | |
| CN | 113833544 | A | | 12/2021 | |
| CN | 114109551 | A | | 3/2022 | |

OTHER PUBLICATIONS

Written Opinion in PCT/CN2022/089477 dated Aug. 23, 2022, 9 pages.
First Office Action in Chinese Application No. 202111411311.3 mailed on Dec. 30, 2021, 11 pages.

* cited by examiner

DRIVING DEVICES FOR A COMPOSITE ENGINE VALVE OF A DEDICATED DRIVING CAM

CROSS-REFERENCE TO RELATED APPLICATIONS

This application is a Continuation of International Application No. PCT/CN2022/089477, filed on Apr. 27, 2022, which claims priority to Chinese Patent Application No. 202111411311.3, filed on Nov. 25, 2021, the entire contents of each of which are hereby incorporated by reference.

TECHNICAL FIELD

The present disclosure relates to the field of driving devices for an engine valve, in particular, to driving devices for a composite engine valve of a dedicated driving cam.

BACKGROUND

The concept and operation manner of compression-released engine brakes are well-known in the heavy commercial vehicle industry. Factors such as cost, power, reliability, and engine change requirements usually have an influence on determining whether an engine brake is used. There are several different types of compression-release engine brakes in a practical application, and an engine braking system with a specialized cam is favored due to the independence and high performance. Drivers (e.g., a rocker arm) of existing valve driving devices that are configured to drive a displacement of individual valves are generally rotationally mounted on rocker arm shafts, and driving cams are required to remain in contact with the drivers, which causes more rotating parts and friction pairs during operation, thereby consuming engine power and increasing wear on parts.

Therefore, it is desirable to provide a driving device for a composite engine valve of a dedicated driving cam to solve problems of the prior arts in which a split valve driving device includes many transmission parts, and an engine power consumption and wear are large.

SUMMARY

One or more embodiments of the present disclosure provide a driving device for a composite engine valve of a dedicated driving cam including a dedicated driving cam configured to be located on a side of an engine positive power cam. The dedicated driving cam includes a base circular portion and a driving lift cam located on the base circular portion. The driving device also includes a valve bridge including an auxiliary piston slidably mounted in an auxiliary piston hole and a driving valve connected to the auxiliary piston. The driving device also includes a driver configured to be fixedly mounted on a rocker arm shaft. The driver includes a main piston cooperating with the dedicated driving cam, and the main piston is slidingly mounted in a main piston hole. The driving device further includes a driving oil circuit configured to be intermittently in communication with the main piston hole and the auxiliary piston hole through a closure and disconnection of the driving oil circuit. The driving oil circuit is in communication with an oil supply circuit through a locating pressure control unit. Under a state that an engine positive work rocker arm does not drive a displacement of the valve bridge, the driving oil circuit is closed and the main piston hole is in communication with the auxiliary piston hole.

Under a state that the oil supply circuit supplies oil to the driving oil circuit when the dedicated driving cam is rotated to the base circular portion to be in a sliding or rolling fit with the main piston, the main piston extends under a hydraulic action of the driving oil circuit to be contacted with the base circular portion. When the dedicated driving cam is rotated to the driving lift cam to be in a sliding or rolling fit with the main piston, the locating pressure control unit is configured to disconnect the driving oil circuit and the oil supply circuit to form a hydraulic linkage between the main piston and the auxiliary piston, such that the driving lift cam is able to drive a displacement of the driving valve connected to the auxiliary piston through the main piston. Under a state that the positive work rocker arm drives the displacement of the valve bridge, the driving oil circuit is disconnected under the displacement of the valve bridge, the hydraulic linkage between the main piston and the auxiliary piston is released, the oil is drained from the auxiliary piston hole, and the auxiliary piston is reset within the valve bridge.

In some embodiments, the driver is provided with a main elastic element configured to drive the main piston to be retracted when pressure is released within the driving oil circuit.

In some embodiments, the oil supply circuit supplies the oil to the driving oil circuit in a unidirectional direction through the locating pressure control unit.

In some embodiments, the driver is provided with a shaft hole matching with the rocker arm shaft, the rocker arm shaft passes through the shaft hole, and the driver is fixedly connected to the rocker arm shaft through the locating pressure control unit.

In some embodiments, the locating control pressure unit includes a locating screw and a one-way assembly. The locating screw includes an oil chamber and an oil inlet channel in communication with the oil chamber, and the oil supply circuit is provided on the rocker arm shaft. The locating screw is threadedly connected to the driver to fix the driver on the rocker arm shaft, the oil chamber remains in communication with the driving oil circuit, the oil supply circuit is in communication with the oil inlet channel, and the one-way assembly is provided on the locating screw to make the oil inlet channel unidirectionally connected to the oil chamber.

In some embodiments, the rocker arm shaft is provided with a locating surface matching with the locating screw, and an end surface of an inner end of the locating screw is in contact with the locating surface.

In some embodiments, the one-way assembly includes an elastic element and a one-way ball, an end of the elastic element abuts against an inner wall of the oil chamber, and another end of the elastic element abuts against a communication position between the oil inlet channel and the oil chamber.

In some embodiments, the driving oil circuit includes a main piston oil channel, an auxiliary piston oil channel, an inner oil channel, and an oil drain channel. The main piston oil channel and the auxiliary piston oil channel are provided in the driver, an end of the main piston oil channel is in communication with the main piston hole, and another end of the main piston oil channel is in communication with the oil chamber. An end of the auxiliary piston oil channel is in communication with the oil chamber, and another end of the auxiliary piston oil channel is in communication with the inner oil channel. The oil drain channel is in communication with the auxiliary piston hole, an elephant foot adjusting bolt that is a position adjustable configuration is provided on the driver, and the inner oil channel passes through the elephant foot adjusting bolt. When the positive work rocker arm does not drive the displacement of the valve bridge, the elephant foot adjusting bolt is in contact with the valve bridge, the inner oil channel is in communication with the oil drain channel, and the driving oil circuit is closed. When the positive work rocker arm drives the displacement of the valve bridge, the elephant foot adjusting bolt is separated from the valve bridge, the inner oil channel is separated from the oil drain channel, and the driving oil circuit is disconnected.

In some embodiments, an auxiliary elastic element is provided between the auxiliary piston and the auxiliary piston hole. The auxiliary elastic element is configured to push the valve bridge closer to the driver.

BRIEF DESCRIPTION OF THE DRAWINGS

The present disclosure is further illustrated in terms of exemplary embodiments. These exemplary embodiments are described in detail according to the drawings. These embodiments are non-limiting exemplary embodiments, in which like reference numerals represent similar structures, wherein.

Figure 1:
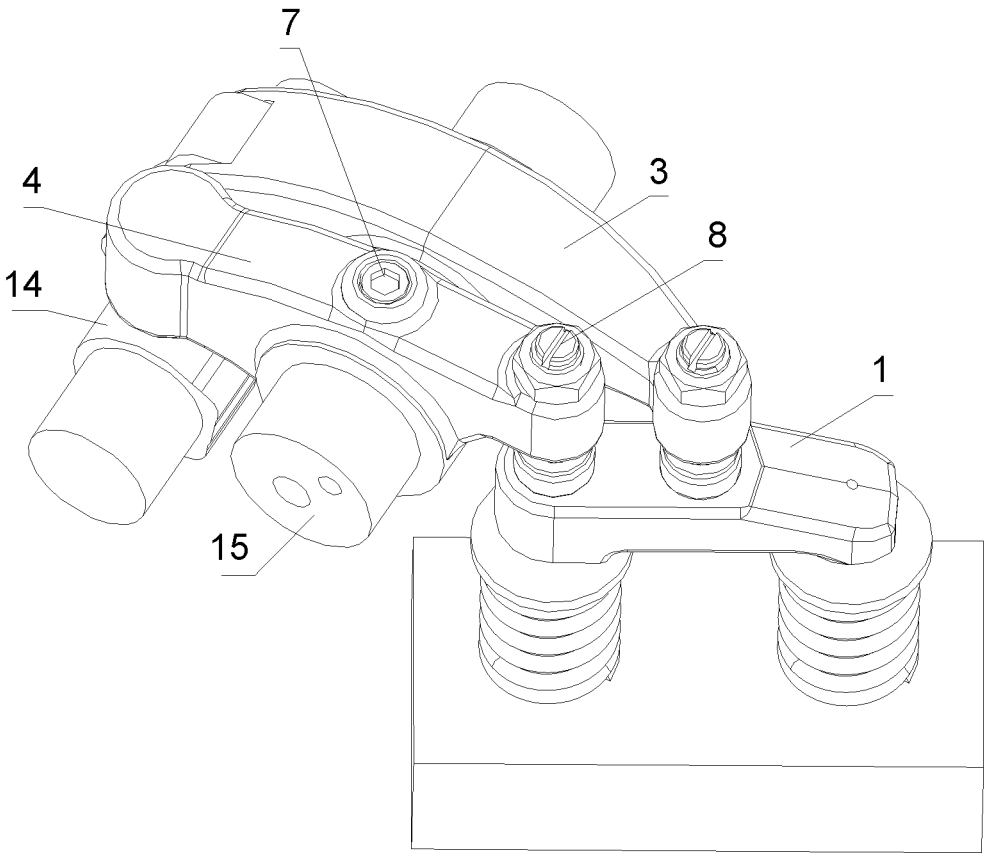
FIG. 1 is a three-dimensional schematic diagram illustrating a driving device for a composite engine valve of a dedicated driving cam according to some embodiments of the present disclosure.

In the drawings: 1, valve bridge; 1-1, auxiliary piston hole; 2, auxiliary piston; 3, positive power rocker arm; 4, driver; 4-1, main piston hole; 4-2, shaft hole; 5, main piston; 6, driving oil circuit, 6-1, main piston oil channel; 6-2, auxiliary piston oil channel; 6-3, inner oil channel; 6-4, oil drain channel; 7, locating pressure control unit; 7-1, locating screw; 7-11, oil chamber; 7-12, oil inlet channel; 7-2, elastic element; 7-3, one-way ball; 8, elephant foot adjusting bolt; 8-1, joint portion; 8-2, joint seat; 9, main elastic element; 10, auxiliary elastic element; 11, limiting element; 13, positive power cam; 13-1, main lifting cam; 14, dedicated driving cam; 14-1, base circular portion; 14-2, driving lift boss; 15, rocker arm shaft; 15-1, locating surface; 16, oil supply circuit; 17, driving valve; 18, non-driving valve.

DETAILED DESCRIPTION

To more clearly illustrate the technical solutions related to the embodiments of the present disclosure, a brief introduction of the drawings referred to the description of the embodiments is provided below. Obviously, the drawings described below are only some examples or embodiments of the present disclosure. Those having ordinary skills in the art, without further creative efforts, may apply the present disclosure to other similar scenarios according to these drawings. Unless obviously obtained from the context or the context illustrates otherwise, the same numeral in the drawings refers to the same structure or operation.

It should be understood that "system", "device", "unit" and/or "module" as used herein is a manner used to distinguish different components, elements, parts, sections, or assemblies at different levels. However, if other words serve the same purpose, the words may be replaced by other expressions.

As shown in the present disclosure and claims, the words "one", "a", "a kind" and/or "the" are not especially singular but may include the plural unless the context expressly suggests otherwise. In general, the terms "comprise," "comprises," "comprising," "include," "includes," and/or "including," merely prompt to include operations and elements that have been clearly identified, and these operations and elements do not constitute an exclusive listing. The methods or devices may also include other operations or elements.

Figure 2:
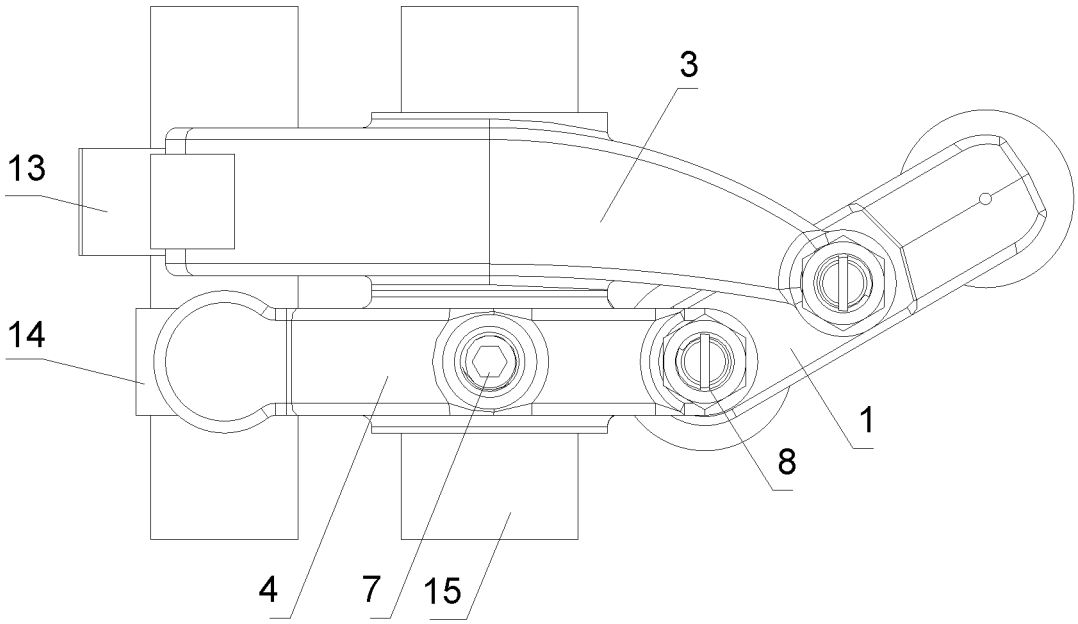
FIG. 2 is a schematic diagram illustrating a top view of a driving device for a composite engine valve of a dedicated driving cam according to some embodiments of the present disclosure.
Figure 3:
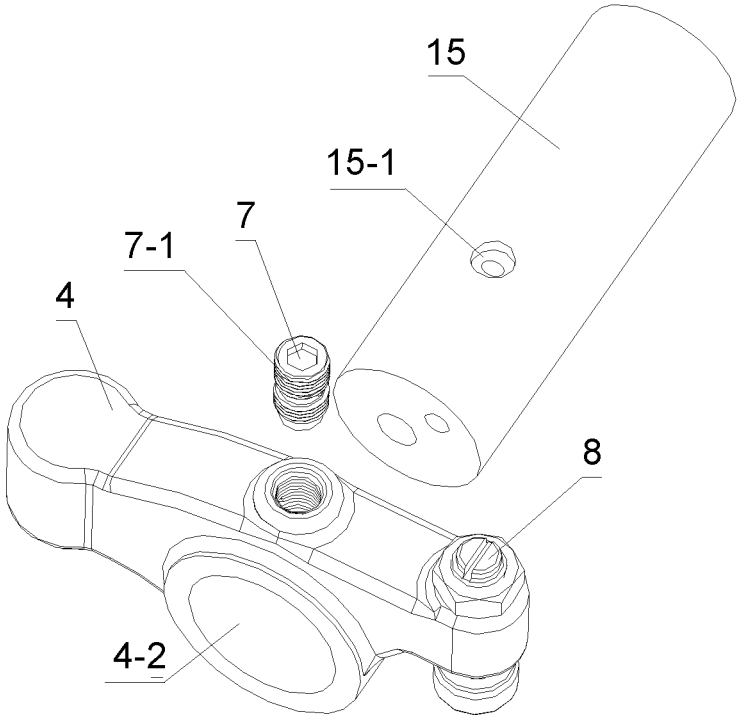
FIG. 3 is an exploded schematic diagram illustrating a driver, a locating pressure control unit, and a rocker arm shaft cooperating with each other according to some embodiments of the present disclosure.
Figure 4:
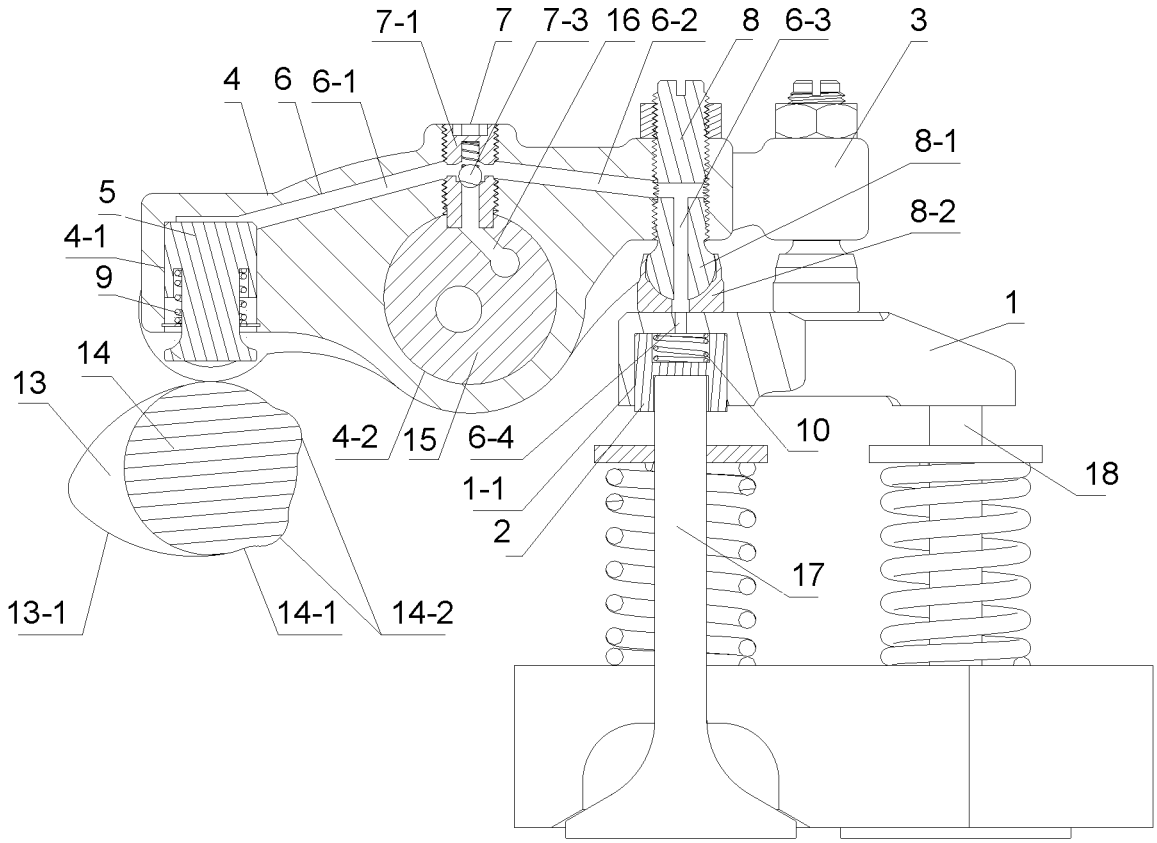
FIG. 4 is a schematic diagram illustrating a dedicated driving cam separated from a main piston according to some embodiments of the present disclosure.
Figure 5:
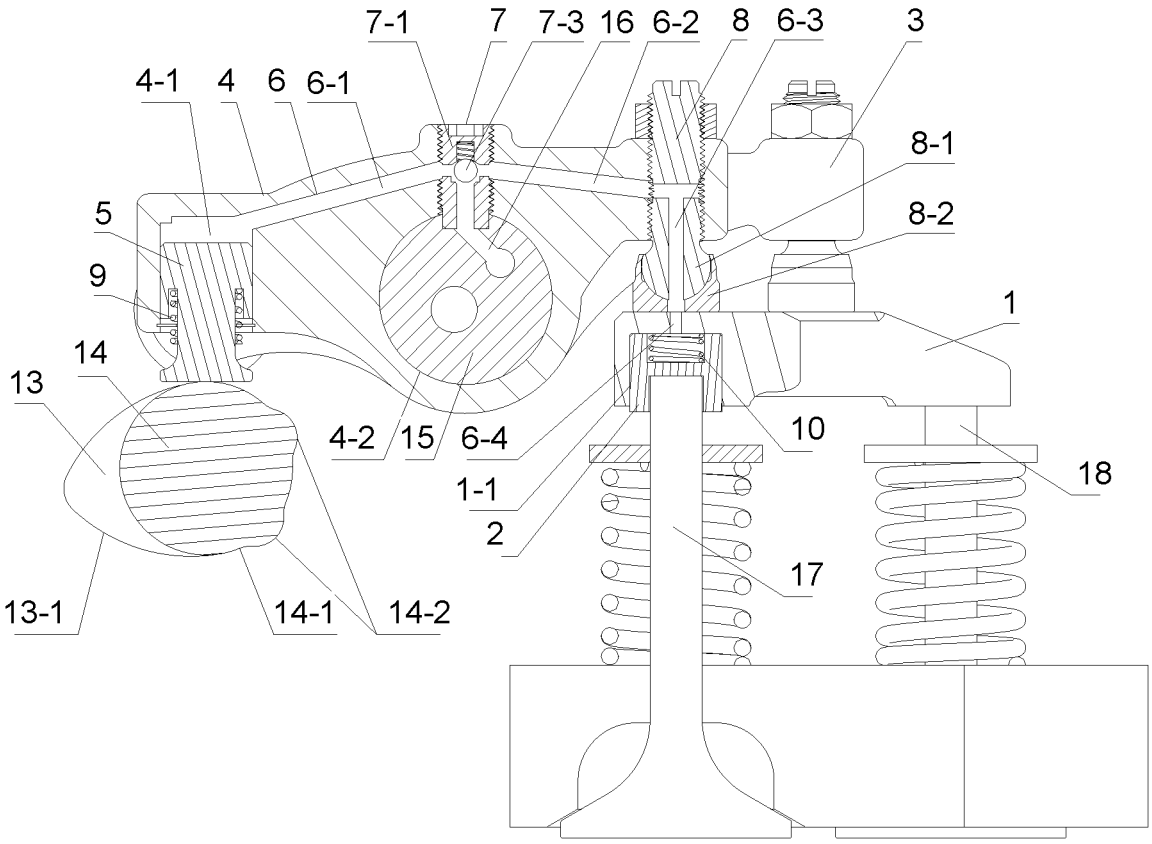
FIG. 5 is a schematic diagram illustrating a hydraulic linkage formed between a hydraulic pressure of a main piston and a hydraulic pressure an auxiliary piston according to some embodiments of the present disclosure.
Figure 6:
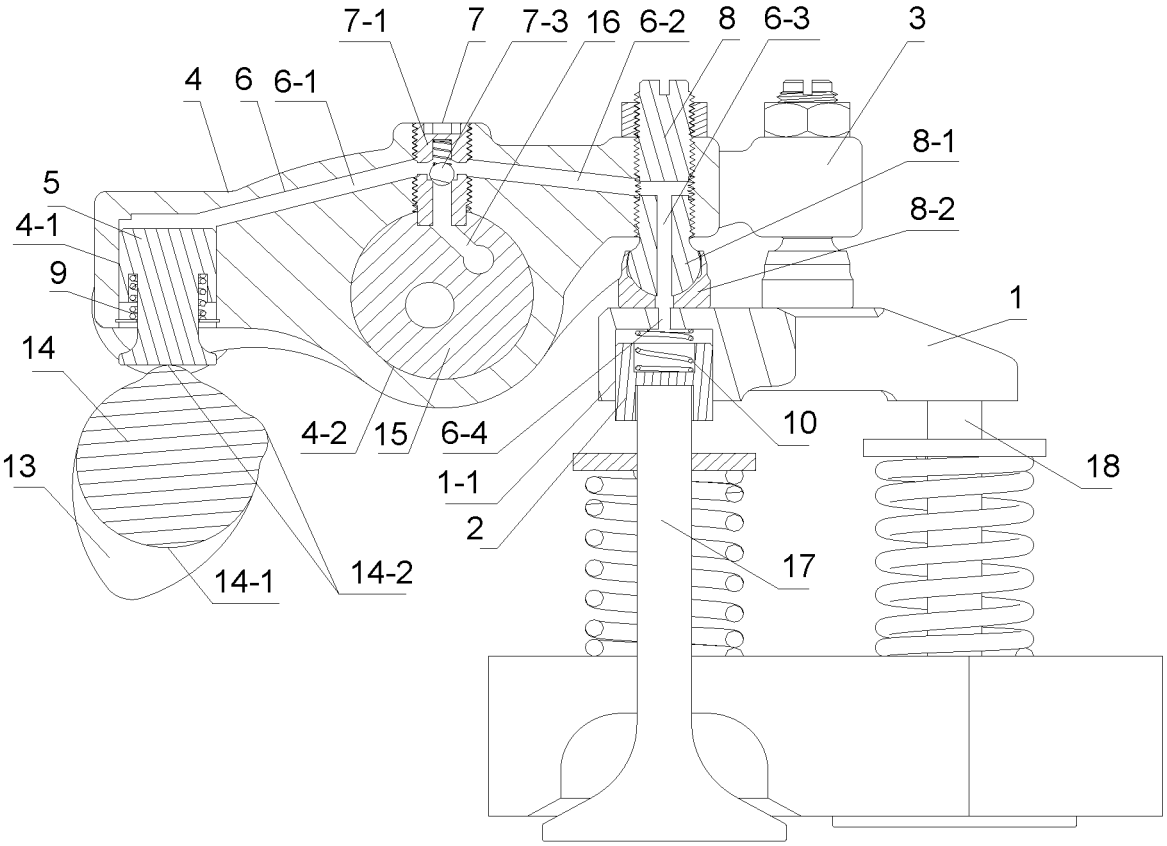
FIG. 6 is a schematic diagram illustrating a dedicated driving cam driving a displacement of a driving valve according to some embodiments of the present disclosure.
Figure 7:
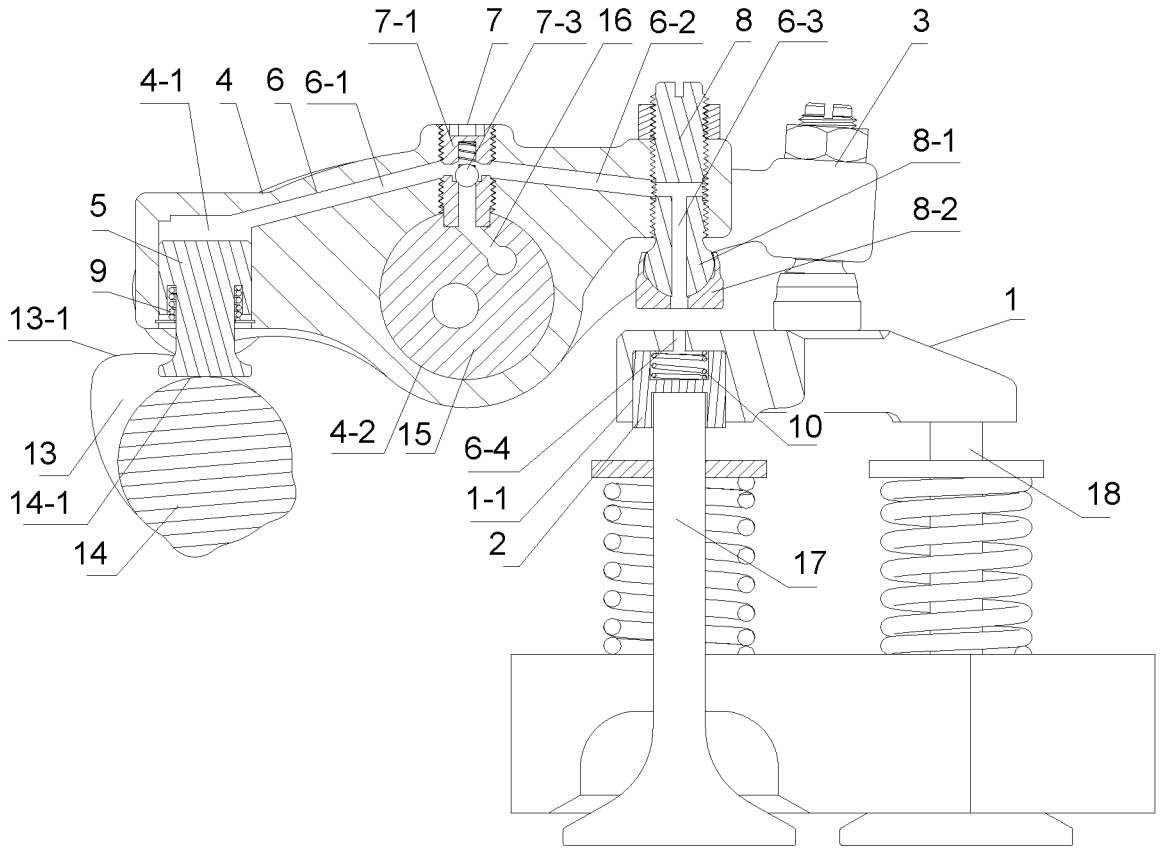
FIG. 7 is a schematic diagram illustrating a positive power rocker arm driving a displacement of a valve bridge according to some embodiments of the present disclosure.

FIG. 1 is a three-dimensional schematic diagram illustrating a driving device for a composite engine valve of a dedicated driving cam according to some embodiments of the present disclosure. FIG. 2 is a schematic diagram illustrating a top view of a driving device for a composite engine valve of a dedicated driving cam according to some embodiments of the present disclosure. FIG. 3 is an exploded schematic diagram illustrating a driver, a locating pressure control unit, and a rocker arm shaft cooperating with each other according to some embodiments of the present disclosure. FIG. 4 is a schematic diagram illustrating a dedicated driving cam separated from a main piston according to some embodiments of the present disclosure. FIG. 5 is a schematic diagram illustrating a hydraulic linkage formed between a hydraulic pressure of a main piston and a hydraulic pressure of an auxiliary piston according to some embodiments of the present disclosure. FIG. 6 is a schematic diagram illustrating a dedicated driving cam driving a displacement of a driving valve according to some embodiments of the present disclosure. FIG. 7 is a schematic diagram illustrating a positive power rocker arm driving a displacement of a valve bridge according to some embodiments of the present disclosure.

As shown in FIGS. 1-7, some embodiments of the present disclosure provide a driving device (also referred to as a valve driving device) for a composite engine valve of a dedicated driving cam. The engine is a four-stroke engine. A driving valve 17 and A non-driving valve 18 of a valve group are exhaust valves in the engine, and a positive power cam 13 is mounted on a cam shaft of the engine.

In some embodiments, the valve driving device includes a dedicated driving cam 14, a valve bridge 1, a driver 4, and a driving oil circuit 6.

The dedicated driving cam 14 refers to a cam structure provided on the cam shaft of the engine. In some embodiments, a shape of the dedicated driving cam 14 may include a circle, an oval, a triangle, a rectangle, or any other feasible shapes.

In some embodiments, the dedicated driving cam 14 is provided on the cam shaft of the engine, which is located on a side of the positive power cam 13 of the engine. The dedicated driving cam 14 includes a base circular portion 14-1 and a driving lift boss 14-2 located on the base circular portion 14-1. In some embodiments, two driving lift bosses 14-2 are provided, which are an exhaust gas recirculation driving lift boss and a compression-released driving lift boss, respectively. The exhaust gas recirculation driving lift boss is configured to make the driving valve 17 perform an exhaust gas recirculation operation, and the compression-released driving lift boss is configured to make the driving valve 17 perform a compression-released operation.

The base circular portion 14-1 is a main portion of the dedicated driving cam 14. The driving lift boss 14-2 is a convex portion provided on the base circular portion 14-1. It should be noted that a shape of the driving lift boss 14-2 and a count of the driving lift boss 14-2 are not limited and may be set based on actual needs. For example, a plurality of driving lift bosses 14-2 may be provided, and the plurality of driving lift bosses 14-2 are provided in pairs on the base circular portion 14-1 to make the driving valve 17 perform the exhaust gas recirculation operation or the compression-released operation.

The valve bridge 1 refers to a structure used to connect and seal the driving valve 17 and the non-driving valve 18. In some embodiments, the valve bridge 1 includes the auxiliary piston 2 slidably mounted in an auxiliary piston hole 1-1, and the driving valve 17 is connected to the auxiliary piston 2. Specifically, an upper end of the driving valve 17 abuts against the auxiliary piston 2, and an upper end of the non-driving valve 18 abuts against the valve bridge 1. It should be noted that, a structure driving the displacement of the valve bridge 1 by the positive power rocker arm 3 when the positive power cam 13 is rotated is a conventional technology. For example, when the positive power cam 13 is rotated to the base circular portion to cooperate with the positive power rocker arm 3, neither the positive power rocker arm 3 nor the valve bridge 1 has the displacement. When the positive power cam 13 is rotated to the main lifting boss 13-1 to cooperate with the positive power rocker arm 3, the main lifting boss 13-1 pushes the positive power rocker arm 3, and the positive power rocker arm 3 drives the displacement of the valve bridge 1. A slidably installation refers to a mounting manner in which two components may slide relative to each other.

The driver 4 refers to a structure configured to drive the displacement of the driving valve 17 by cooperating with the dedicated driving cam 14. In some embodiments, the driver 4 is fixedly mounted on the rocker arm shaft 15 and the driver 4 includes the main piston 5 used to cooperate with the dedicated driving cam 14. The main piston 5 is slidably mounted in the main piston hole 4-1.

Figure 8:
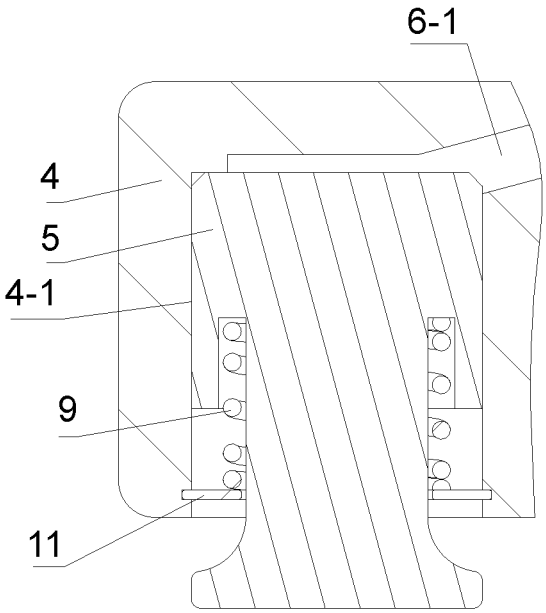
FIG. 8 is a schematic diagram illustrating a main piston installed on a driver according to some embodiments of the present disclosure.

More descriptions regarding the driver 4 may be found elsewhere in the present disclosure (e.g., FIG. 8 and related description thereof).

The driving oil circuit 6 is a structure provided in the driver 4 used to realize the hydraulic linkage between the main piston 5 and the auxiliary piston 2. In some embodiments, the driving oil circuit 6 is intermittently in communication with the main piston hole 4-1 and the auxiliary piston hole 1-1 through a closure and disconnection of the driving oil circuit 6, and the driving oil circuit 6 is in communication with an oil supply circuit 16 through the locating pressure control unit 7.

More descriptions regarding the driving oil circuit may be found elsewhere in the present disclosure (e.g., FIGS. 4-7 and related descriptions thereof). Specific descriptions regarding the locating pressure control unit 7 may be found elsewhere in the present disclosure (e.g., FIGS. 8-9 and related descriptions thereof).

In some embodiments, under a state that the engine positive power rocker arm does not drive a displacement of the valve bridge 1, the driving oil circuit 6 is closed and the main piston hole 4-1 is in communication with the auxiliary piston hole 1-1. At the same time, under a state that the oil supply circuit 16 supplies oil to the driving oil circuit 6, when the dedicated driving cam 14 is rotated to the base circular portion 14-1 to be in a sliding or rolling fit with the main piston 5, the main piston 5 extends under a hydraulic action of the driving oil circuit 6 to be contacted with the base circular portion 14-1. When the dedicated driving cam 14 is rotated to the driving lift boss 14-2 to be in a sliding or rolling fit with the main piston 5, the locating pressure control unit 7 disconnects the driving oil circuit 6 and the oil supply circuit 16 to form a hydraulic linkage between the main piston 5 and the auxiliary piston 2, such that the driving lift boss 14-2 is able to drive a displacement of the driving valve 17 connected to the auxiliary piston 2 through the main piston 5. If the main piston 5 includes a flat surface or a curved surface, the base circular portion 14-1 and the driving lift boss 14-2 are in contact with the flat surface or the curved surface when cooperating with the main piston 5, thereby forming a sliding fit with the main piston 5, respectively. If the main piston 5 is rotationally provided with a roller, the base circular portion 14-1 and the driving lift boss 14-2 are in contact with the roller, thereby forming the rolling fit with the main piston 5, respectively.

Under the state that the positive power rocker arm 3 drives the displacement of the valve bridge 1, the driving oil circuit 6 is disconnected under the displacement of the valve bridge 1, the hydraulic linkage between the main piston 5 and the auxiliary piston 2 is released, the oil is drained from the auxiliary piston hole1-1, and the auxiliary piston 2 is reset within the valve bridge 1.

In some embodiments, under a state that the hydraulic leakage is formed between the main piston 5 and the auxiliary piston 2, when the dedicated driving cam 14 is rotated to the base circular portion 14-1 to be in the sliding or rolling fit with the main piston 5, the displacement of the main piston 5 does not occur. When the dedicated driving cam 14 is rotated to the driving lifting boss 14-2 to be in the sliding or rolling fit with the main piston 5, the driving lifting boss 14-2 pushes the main piston 5, so that the displacement of the main piston 5 occurs, and the displacement of the auxiliary piston 2 occurs accordingly, so that the auxiliary piston 2 drives the displacement of the driving valve 17connected the auxiliary piston 2.

FIG. 8 is a schematic diagram illustrating a main piston mounted on a driver according to some embodiments of the present disclosure.

As shown in FIG. 8, the driver 4 is provided with a main elastic element 9 configured to drive the main piston 5 to be retracted when pressure is released within the driving oil circuit 6, thereby using an elastic force of the main elastic element 9 to keep the main piston 5 separated from the dedicated driving cam 14 at an initial position. Only when the driving oil circuit 6 is supplied with oil, the main piston 5 is able to move to contact the dedicated driving cam 14 through overcoming the elastic force of the main elastic element 9 by using a hydraulic pressure. The main elastic element 9 may be a compression spring, and a specific installation structure includes an opening of the main piston hole 4-1 facing downward, a lower end of the main piston hole 4-1 being fixed to a limiting element 11, an end of the main elastic element 9 abutting against the limiting element 11, and another end of the main elastic element 9 abutting against the main piston 5. When the main piston 5 is in contact with the limiting element 11, the main piston 5 arrives at a maximum stroke of downward displacement. The limiting element 11 is an element used to limit the main elastic element 9. The limiting member 11 may have various structural forms, such as a limiting block, a limiting ring, etc.

It should be noted that any other feasible structure or element may also be designated as the main elastic element 9, which is capable of driving the main piston 5 to be retracted when pressure is released within the driving oil circuit 6.

In order to achieve a rigid hydraulic linkage, in some embodiments, the oil supply circuit 16 supplies oil to the driving oil circuit 6 in a unidirectional manner through the locating pressure control unit 7. When the main piston 5 and the auxiliary piston 2 are in the hydraulic leakage, a reverse cut-off of the locating pressure control unit 7 is used to force oil in the driving oil circuit 6 not to flow back to the oil supply circuit 16, thereby realizing the rigid hydraulic leakage between the main piston 5 and the auxiliary piston 2.

In order to improve compactness of the structure, in some embodiments, as shown in FIG. 3, the driver 4 is provided with a shaft hole 4-2 matching with the rocker arm shaft 15, the rocker arm shaft 15 passes through the shaft hole 4-2, and the driver 4 is fixedly connected to the rocker arm shaft 15 through the locating pressure control unit 7. It should be noted that a dimension (e.g., an aperture) of the shaft hole 4-2 may be determined based on a dimension (e.g., an outer diameter) of the rocker arm shaft 15.

A fixed connection is a connection in which parts or components are fixed without any relative movement. The fixed connection may include a detachable connection (e.g., a threaded connection, etc.) and a non-detachable connection (e.g., a welded connection, etc.).

The locating pressure control unit 7 is a component fixedly connected to the driver 4 and the rocker arm shaft 15, which realizes a communication between the oil supply circuit 16 and the driving oil circuit 6. In some embodiments, the oil supply circuit 16 is provided within the rocker arm shaft 15 and the driving oil circuit 6 is provided within the driver 4. The oil supply circuit 16 may supply the oil to the driving oil circuit 6 in a unidirectional direction through the locating pressure control unit 7.

In some embodiments, the locating pressure control unit 7 may be designed in a plurality of structures to achieve a communication of the oil supply circuit 16 and the driving oil circuit 6 while achieving a fixed connection of the driver 4 and the rocker arm shaft 15. For example, the fixed connection between the driver 4 and the rocker arm shaft 15 may be achieved by using a one-piece molded structure, and a valve structure (e.g., a multi-directional valve) may be used to achieve a connection between the oil supply circuit 16 and the driving oil circuit 6.

Figure 9:
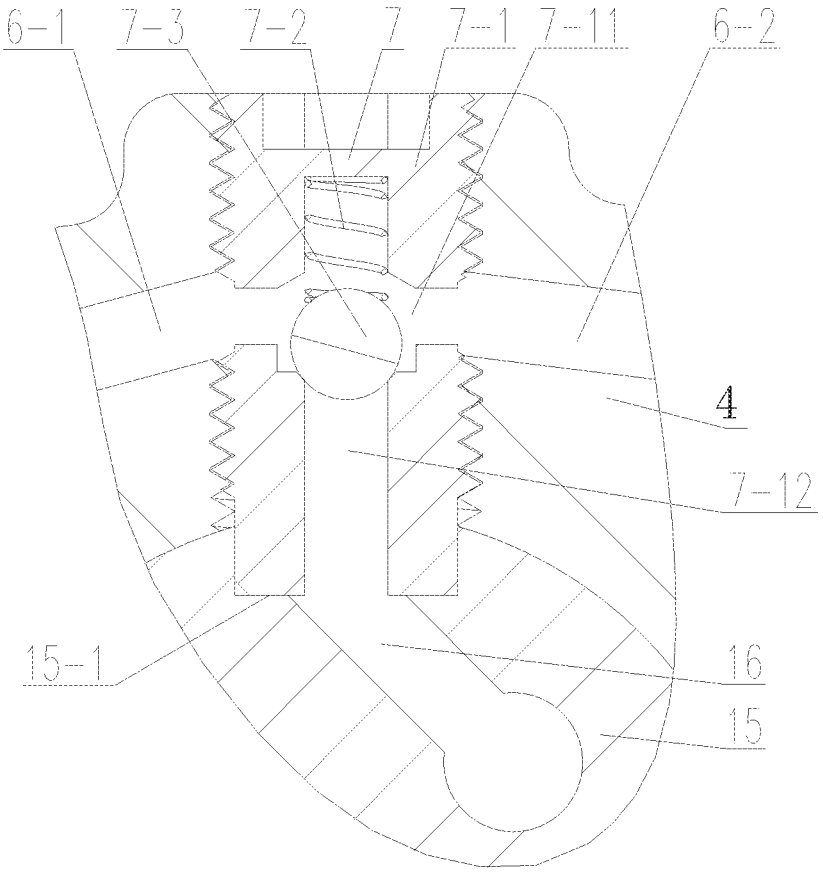
FIG. 9 is a schematic diagram illustrating a locating pressure control unit according to some embodiments of the present disclosure.

FIG. 9 is a schematic diagram illustrating a locating pressure control unit according to some embodiments of the present disclosure.

As shown in FIG. 3 and FIG. 9, the locating pressure control unit 7 includes a locating screw 7-1 and a one-way assembly. The locating screw 7-1 includes an oil chamber 7-11 and an oil inlet channel 7-12 connected to the oil chamber 7-11, and the oil supply circuit 16 is provided on the rocker arm shaft 15. The locating pressure control unit 7 including the locating screw 7-1 and the one-way assembly has an advantage of a simple structure. In addition, during installation, the locating screw 7-1 merely needs to be tightened on the driver 4 to achieve that the locating pressure control unit 7 is fixed on the driver 4 and the driver 4 is fixed on the rocker arm shaft 15, so as to simplify an assembly process and improve production efficiency.

In some embodiments, a threaded connection between the locating screw 7-1 and the driver 4 may achieve that the driver 4 is fixed on the rocker arm shaft 15, the oil chamber 7-11 is kept in communication with the driving oil circuit 6, the oil supply circuit 16 is in communication with the oil inlet channel 7-12, the one-way assembly is provided on the locating screw 7-1, and the oil inlet channel 7-12 is unidirectionally connected to the oil chamber 7-11. The locating screw 7-1 refers to a structure used to fixedly connect the driver 4 and the rocker arm shaft 15. The oil chamber 7-11 and the oil inlet channel 7-12 are provided within the locating screw 7-1, the oil chamber 7-11 may be configured to temporarily accommodate or store part of the oil, and the oil chamber 7-11 may be in communication with the driving oil circuit 6 and the oil inlet channel 7-12. The oil inlet channel 7-12 may be configured to be in communication with the oil supply circuit 16 and the oil chamber 7-11, thereby realizing a communication between the oil supply circuit 16 and the driving oil circuit 6.

In some embodiments of the present disclosure, the locating pressure control unit uses the locating screw and the one-way assembly to simplify a manufacturing process and make assembly easier.

In some embodiments, the rocker arm shaft 15 is provided with a locating surface 15-1 that matches the locating screw 7-1, and an end surface of an inner end of the locating screw 7-1 is in contact with the locating surface 15-1, which makes the driver 4 fixed on the rocker arm shaft 15. It should be noted that, the locating screw 7-1 is also capable of fixing the driver 4 on the rocker arm shaft 15 by directly abutting against a peripheral surface of the rocker arm shaft 15. A fixing effect of the locating screw 7-1 may be further improved by providing the locating surface 15-1 on the rocker arm shaft 15 that matches the locating screw 7-1, and making the end surface of the inner end of the locating screw 7-1 in contact with the locating surface 15-1.

In some embodiments, the one-way assembly includes an elastic element 7-2 and a one-way ball 7-3, and the elastic element 7-2 may be a compression spring. An end of the elastic element 7-2 abuts against an inner wall of the oil chamber 7-11, and another end of the elastic element 7-2 abuts against a communication position between the oil inlet channel 7-12 and the oil chamber 7-11. The one-way ball 7-3 abuts against the communication position between the oil inlet channel 7-12 and the oil chamber 7-11 to prevent oil in the oil chamber 7-11 from entering the oil inlet channel 7-12. However, when the oil is supplied to the oil chamber 7-11 through the oil inlet channel 7-12, the elastic element 7-2 may be compressed, the communication position between the oil inlet channel 7-12 and the oil chamber 7-11 is opened through the one-way ball 7-3, and the oil inlet channel 7-12 is in communication with the oil chamber 7-11, thereby further simplifying a structure of the locating pressure control unit 7 and reducing production costs.

It should be noted that, the one-way assembly may also be any other feasible structure. For example, a one-way valve may also be used directly as the one-way assembly in the embodiment. The elastic element 7-2 may also be any other feasible structure or element, as long as the element meets a requirement that an end of the element is able to abut against an inner wall of the oil chamber 7-11, and another end of the element is able to abut against the communication position between the oil inlet channel 7-12 and the oil chamber 7-11.

To facilitate adjusting sealing performance of the driving oil circuit 6 when the driving oil circuit 6 is closed, in some embodiments, as shown in FIGS. 4-7, the driving oil circuit 6 includes a main piston oil channel 6-1, an auxiliary piston oil channel 6-2, an inner oil channel 6-3, and an oil drain channel 6-4. An end of the main piston oil channel 6-1 is in communication with the main piston hole 4-1, and another end of the main piston oil channel 6-1 is in communication with the oil chamber 7-11. An end of the auxiliary piston oil channel 6-2 is in communication with the oil chamber 7-11 and another end of the auxiliary piston oil channel 6-2 is in communication with the inner oil passage 6-3. The main piston oil channel 6-1 and the auxiliary piston oil channel 6-2 are provided within the driver 4, and the oil drain channel 6-4 is in communication with the auxiliary piston hole 1-1. In some embodiments, an elephant foot adjusting bolt 8 whose position is adjustable is provided on the driver 4, and a threaded connection is provided between the elephant foot adjusting bolt 8 and the driver 4. After a position of the elephant foot adjusting bolt 8 is adjusted, a locking nut is tightened to fix the elephant foot adjusting bolt 8 on the driver 4, so as to realize that the position of the elephant foot adjusting bolt 8 is adjustable. The elephant foot adjusting bolt 8 includes a joint seat 8-2 and a joint portion 8-1, a spherical secondary connection or a rotating secondary connection is formed between the joint seat 8-2 and the joint portion 8-1, and a plane contact is formed between the joint seat 8-2 and the valve bridge 1, thereby realizing a rotatable sealing connection between the joint seat 8-2 and the valve bridge 1. The inner oil channel 6-3 passes through the joint seat 8-2 and the joint portion 8-1 of the elephant foot adjusting bolt 8. In the embodiment, during commissioning, an initial gap between the joint seat 8-2 and the valve bridge 1 may be changed by changing an axial position of the elephant foot adjusting bolt 8, thereby adjusting the sealing performance of the driving oil circuit 6 when the driving oil circuit 6 is closed.

When the positive power rocker arm 3 does not drive the displacement of the valve bridge 1, the elephant foot adjusting bolt 8 is in contact with the valve bridge 1, the inner oil channel 6-3 is in communication with the oil drain channel 6-4, and the driving oil circuit 6 is closed. When the positive power rocker arm 3 drives the displacement of the valve bridge 1, the elephant foot adjusting bolt 8 is separated from the valve bridge 1, the inner oil channel 6-3 is separated from the oil drain channel 6-4, so that the oil is drained, respectively, and the driving oil circuit 6 is disconnected.

In order to improve the sealing performance when the driving oil circuit 6 is closed, in some embodiments, the auxiliary elastic element 10 used to push the valve bridge 1 close to the driver 4 is provided between the auxiliary piston 2 and the auxiliary piston hole 1-1. The valve bridge 1 is in seamless contact and sealing connection with the elephant foot adjusting bolt 8 under an elastic action of the auxiliary elastic element 10, the auxiliary elastic element 10 specifically employs the compression spring, an end of the auxiliary elastic element 10 abuts against the driving valve 17, and another end of the auxiliary elastic element 10 abuts against a bottom hole of the auxiliary piston hole 1-1.

It should be noted that the auxiliary elastic element 10 may also be any other feasible structure or element, as long as the element satisfies a requirement to be able to push the valve bridge 1 close to the driver 4.

In some embodiments, a driving device for a composite engine valve of a dedicated driving cam provided in some embodiments of the present disclosure operates as follows.

A cam shaft of the engine drives the positive power cam 13 and the dedicated driving cam 14 to rotate.

When a solenoid valve of the engine is turned off, as shown in FIG. 4, the oil supply circuit 16 stops supplying oil, the driving circuit 6 has no oil pressure, the main piston 5 is reset under an action of the main elastic element 9 and is separated from the dedicated driving cam 14. In a rotating process of the dedicated driving cam 14, the dedicated driving cam 14 is not in contact with the driver 4, and a driving lift of the dedicated driving cam 14 is not transferred. When the positive power cam 13 is rotated to a positive power lift boss to be in contact with the positive power rocker arm 3, the positive power rocker arm 3 rotates and drives the displacement of the valve bridge 1, the driving valve 17 and the non-driving valve 18 are turned on simultaneously, and a general positive power lift of the valve is completed;

When the solenoid valve of the engine is turned on, as shown in FIG. 5, the oil supply circuit 16 supplies oil to the driving oil circuit 6 in a unidirectional direction through the one-way assembly in the locating pressure control unit 7, the inner oil channel 6-3 is in communication with the oil drain channel 6-4 when the displacement of the valve bridge 1 does not occur, and the driving oil circuit 6 is closed. The driving oil circuit 6 begins to store the oil so that the oil in the driving oil circuit 6 forces the main piston 5 to be extended by overcoming the elastic force of the main elastic element 9, thereby contacting the base circular portion 14-1 of the dedicated driving cam 14. As shown in FIG. 6, when the dedicated driving cam 14 is rotated to the driving lift boss 14-2 to be in contact with the main piston 5, the driving lift boss 14-2 pushes the main piston 5 and the one-way assembly in the locating pressure control unit 7 to prevent the oil from flowing back from the driving oil circuit 6 to the oil supply circuit 16. The hydraulic linkage is formed between the main piston 5 and the auxiliary piston 2, and the displacement of the auxiliary piston 2 occurs along with the main piston 5, so that the auxiliary piston 2 drives the displacement of the driving valve 17 connected to the auxiliary piston 2, thereby realizing that the engine opens the driving valve 17 according to a lift of the dedicated driving cam 14. As shown in FIG. 7, when the positive power cam 13 begins to be rotated to a positive power lift, the positive power rocker arm 3 pushes the valve bridge 1 downwardly, and the driving valve 17 and the non-driving valve 18 achieve the positive power lift. At the same time, the valve bridge 1 is separated from the joint seat 8-2 of the elephant foot adjusting bolt 8, so that the driving oil circuit 6 is disconnected, the inner oil channel 6-3 is separated from the oil drain channel 6-4, the main piston 5 is reset under an action of the main elastic element 9, and oil drainage occurs in the inner oil channel 6-3. Oil in the auxiliary piston hole 1-1 is drained out through the oil drain channel 6-4 under a pressure of the driving valve 17, and the auxiliary piston 2 is reset and retracted to an unexpanded position, so that the entire valve driving device is restored to a positive power posture.

In some embodiments, the valve driving device further includes a pre-warning module, a pressure sensor, and a processor. The pre-warning module is configured to issue a replacement warning signal in response to failure risks existing in the elastic element 7-2, the main elastic element 9, and the auxiliary elastic element 10. The pressure sensor is configured to measure the elastic force of the elastic element 7-2, the main elastic element 9, and the auxiliary elastic element 10. The processor is configured to generate a pre-warning instruction in response to a determining that the elastic force of at least one of the elastic element 7-2, the main elastic element 9, and the auxiliary elastic element 10 is less than a predetermined threshold, and send the pre-warning instruction to the pre-warning module.

The pressure sensor may be configured to measure an elastic force of an elastic part. In some embodiments, one or more pressure sensors may be provided, and a plurality of pressure sensors may be provided on the elastic part (e.g., the elastic element 7-2, the main elastic element 9, and the auxiliary elastic element 10), which are used to measure the elastic force of each elastic part.

It should be noted that when the count of pressure sensors is one, the pressure sensor may be provided on any one of the elastic element 7-2, the main elastic element 9, and the auxiliary elastic element 10, which is used to measure the elastic force of the elastic part (e.g., the elastic element 7-2). In some embodiments, in response to a determining that the elastic force of the elastic part is less than the predetermined threshold, the processor may generate the pre-warning instruction and send the pre-warning instruction to the pre-warning module.

The processor may be configured to process data and/or information related to pre-warning to perform functions described in the embodiments. For example, the processor may receive data and/or information sent by the pressure sensor and process the data and/or the information.

In some embodiments, the processor may include one or more sub-processing devices (e.g., a single-core processing device or a multi-core processing device). Merely by way of example, the processor may include one or any combination of a central processing unit (CPU), an application-specific integrated circuit (ASIC), a controller, a microcontroller unit, etc.

In some embodiments, the processor may also include a register configured to store data obtained, transmitted, or processed by the processor. For example, the processor may store the elastic force of each elastic part obtained from the pressure sensor to the register.

It should be noted that signal transmission between the processor and another component of the valve driving device (e.g., the pre-warning module, the pressure sensor, etc.) may be implemented based on a plurality of manners. For example, the signal transmission manner mentioned above may include a wired transmission manner (e.g., Ethernet, cable, etc.), a wireless transmission manner (e.g., Bluetooth, WiFi, etc.), or any other feasible transmission manners.

The pre-warning module is a module configured to alert and warn a user. The pre-warning module may be a separate module or may be integrated into the processor as part of the processor.

In some embodiments, the processor may control the pre-warning module to send the replacement warning signal when a failure risk exists in at least one of the elastic element 7-2, the main elastic element 9, and the auxiliary elastic element 10.

The replacement warning signal is a signal used to alert and warn the user to replace relevant elastic part (e.g., the elastic element 7-2, the main elastic element 9, and the auxiliary elastic element 10). For example, the replacement warning signal may include a warning sound (e.g., a siren), a warning beacon (e.g., a flashing red light), a warning text, etc.

The failure risk is a risk of a significant reduction or even loss of the elastic force of the elastic part. In some embodiments, when the elastic force of at least one of the elastic element 7-2, the main elastic element 9, and the auxiliary elastic element 10 is less than the predetermined threshold, the elastic element 7-2, the main elastic element 9, and the auxiliary elastic element 10 may be considered to have the failure risk. The elastic force of the elastic part refers to a force that may make the elastic part recover to an original shape when an external force is withdrawn after a deformation of the elastic part caused by the external force.

The pre-warning instruction is an instruction related to controlling the pre-warning module to issue the replacement warning signal. In some embodiments, when the elastic force of the elastic element 7-2 is less than a corresponding predetermined threshold, the processor may automatically generate a corresponding pre-warning instruction (e.g., a pre-warning instruction used to replace the elastic element 7-2) and send the corresponding pre-warning instruction to the pre-warning module. In some embodiments, when the elastic force of the main elastic element 9 is less than a corresponding predetermined threshold, the processor may automatically generate a corresponding pre-warning instruction (e.g., a pre-warning instruction used to replace the main elastic element 9) and send the corresponding pre-warning instruction to the pre-warning module. In some embodiments, when the elastic force of the auxiliary elastic element 10 is less than a corresponding predetermined threshold, the processor may automatically generate a corresponding pre-warning instruction (e.g., a pre-warning instruction used to replace the auxiliary elastic element 10) and send the corresponding pre-warning instruction to the pre-warning module.

In some embodiments, when the pre-warning module receives a corresponding pre-warning instruction, the controller may control the pre-warning module to execute the pre-warning instruction, and the pre-warning module may issue a corresponding replacement warning signal.

In some embodiments of the present disclosure, the valve driving device may realize monitoring and pre-warning of the elastic force of each elastic part by setting up the pre-warning module, the pressure sensor, and the processor, so as to detect and solve problems in time, thereby improving stability and reliability of the valve driving device.

The predetermined threshold is a threshold of elastic force which is set in advance. In some embodiments, the predetermined threshold may be uniformly predetermined. That is, each elastic part has a same predetermined threshold.

In some embodiments, the predetermined threshold may be determined in a plurality of manners. In some embodiments, the predetermined threshold may be determined based on historical data, analog simulations, etc.

In some embodiments, the predetermined threshold may also be determined based on pre-commissioning elastic test data of each elastic part (e.g., the elastic element 7-2, the main elastic element 9, and the auxiliary elastic element 10) before each elastic part is placed in service. Pre-commissioning elastic test data may be relevant data obtained by testing each elastic part before each elastic part is placed into service. For example, the pre-commissioning elastic test data at least includes an initial elastic force of each elastic part. In some embodiments, the pre-commissioning elastic test data may be obtained by measurement of the pressure sensor.

It may be understood that if each elastic part has a same predetermined threshold, the pre-commissioning elastic test data of each elastic element should be substantially the same. That is, an initial elastic feature of each elastic part is substantially the same. For example, an initial elastic force, an initial length, etc., of each elastic part is basically the same.

In some embodiments, the elastic element 7-2, the main elastic element 9, and the auxiliary elastic element 10 (collectively referred to as the elastic part) may have different predetermined thresholds. The predetermined threshold for each elastic part is determined based on historical elastic test data for each elastic part. Merely by way of example, the historical elastic test data may be data including the elastic force of each elastic part or the like obtained by testing each elastic part after each elastic part is stretched by a predetermined count of times. In some embodiments, a predetermined count of stretches may be predetermined.

In some embodiments of the present disclosure, pre-warning accuracy may be improved to a certain extent by setting a predetermined threshold value corresponding to each elastic part.

In some embodiments, the valve driving device further includes one or more displacement sensors, and the one or more displacement sensors are provided on at least one of a position on each elastic part and a position around each elastic part. The predetermined threshold of each elastic part is related to a current deformation feature of each elastic part, and the deformation feature is determined based on displacement data collected by the one or more displacement sensors.

The deformation feature may be used to reflect deformation of each elastic part. In some embodiments, the deformation feature may at least include a deformation amount.

In some embodiments, a current deformation feature of each elastic part may be the same or different, which may be determined based on the displacement data collected by a corresponding displacement sensor.

In some embodiments, when each elastic part is in a different deformation situation, the elastic force generated by each elastic part is different, which is necessary to determine different predetermined thresholds based on the current deformation feature of each elastic part. Merely by way of example, the predetermined threshold value a of the elastic part (e.g., the elastic element 7-2) with a particular deformation feature X may be denoted as a=s−x, wherein, s denotes a standard elastic force of the elastic part (e.g., the elastic element 7-2) with the particular deformation feature X, and x denotes a predetermined difference value. In some embodiments, s may be determined based on historical elastic test data, and x may be a fixed value, which is determined by manual presetting.

In some embodiments, each elastic part has a different predetermined difference value, and the predetermined difference value correlates to a cumulative usage intensity of each elastic part. The cumulative usage intensity of each elastic part is determined based on an accumulation of historical deformation data for each elastic part.

The cumulative usage intensity of each elastic part reflects cumulative deformation of each elastic part from a time that each elastic part starts to be put into service to a current moment.

The historical deformation data is a collection of displacement data of each elastic part collected by the displacement sensor. In some embodiments, the historical deformation data may include the deformation feature. In some embodiments, the processor may continuously collect and update the displacement data of each elastic part, and record the displacement data in the register, so that the processor may obtain the historical deformation data of each elastic part directly from the register.

In some embodiments, the cumulative usage intensity of each elastic part may be calculated. Merely by way of example, the cumulative usage intensity $W=K_1*T_{1+}K_2*T_{2+} \ldots +K_n*T_n$, wherein $T_1$ denotes a cumulative duration of the elastic part with a deformation feature $X_1$, and $T_n$ denotes a cumulative duration of the elastic part with a deformation feature $X_n$. $K_n$ is related to a current deformation feature $X_n$ of the elastic part, and the larger the deformation feature $X_n$, the larger the $K_n$. It should be noted that $T_1, T_2, \ldots$, and $T_n$ may be continuous or discontinuous, and n is an integer greater than 0.

In some embodiments, the greater the cumulative usage intensity of each elastic part, the longer the service time of each elastic part, the more likely that the elastic force of each elastic part may undergo a great reduction or degradation. Therefore, the predetermined threshold value of each elastic part may be appropriately decreased. That is, the predetermined difference value may be correspondingly increased. By comprehensively considering the cumulative usage intensity of each elastic part, the predetermined threshold of each elastic part is appropriately adjusted, which improves rationality of the pre-warning.

In some embodiments of the present disclosure, by further determining the predetermined threshold of each elastic part based on the current deformation feature of each elastic part, it is beneficial to improve accuracy of the predetermined threshold, which in turn improves accuracy of the pre-warning.

In some embodiments, the valve driving device further includes one or more sound sensors configured to be provided at one or more predetermined positions on an outside of the valve, and the predetermined position(s) at least includes a surface of the positive power rocker arm 3.

The predetermined position(s) refers to a predetermined position of the sound sensor. For example, the predetermined position(s) may include the surface of the positive power arm rocker 3, a surface of the driver 4, etc. In some embodiments, a predetermined position may be correspondingly provided with a sound sensor used to collect sound data.

In some embodiments, the processor is further configured to determine a failure probability distribution of the valve driving device based on the sound data collected by the sound sensor. The failure probability distribution may include a failure probability of the valve driving device and/or a component of the valve driving device.

The sound data refers to data related to an operation sound of the valve driving device. For example, the sound data may at least include a vibration frequency of the valve driving device. In some embodiments, the sound data may be data collected by one or more sound sensors over a short time interval. The short time interval may be predetermined based on practical conditions.

The failure probability distribution may be used to reflect a location and a probability of valve driving device having a failure.

Based on the sound data collected by the sound sensor, the processor may determine the failure probability distribution of the valve driving device in a plurality of manners. In some embodiments, the processor may embed the sound data through an embedding model to obtain a first embedding vector, perform a matching in a vector database based on the first embedding vector, and determine the failure probability distribution of the valve driving device based on historical actual failures corresponding to one or more target vectors whose matching similarity satisfies a predetermined condition.

In some embodiments, the embedding model may be a machine learning model. In some embodiments, the embedding model may be obtained by training based on a first training sample with a large count of first labels. In some embodiments, the embedding model may include an embedding layer as described in the following illustrations.

Merely by way of example, the first embedding vector is matched in the vector database to obtain three target vectors with three matching similarities (e.g., S1, S2, and S3) that satisfy the predetermined condition. Historical actual failures corresponding to the three target vectors are failure A, failure B, and failure C, respectively, so that the current failure probability distribution of the valve driving device may be (P1, P2, P3), wherein P1, P2, and P3 denote an occurrence probability of failure A, failure B, and failure C, respectively. In some embodiments, a failure occurrence probability P is positively correlated to a matching similarity S (e.g., P1 is correlated to the matching similarity S1, P2 is correlated to the matching similarity S2, and P3 is correlated to the matching similarity S3).

The predetermined condition is a predetermined matching condition. In some embodiments, the predetermined condition may include the matching similarity satisfying a similarity threshold, etc. The similarity threshold may be predetermined.

It should be noted that the vector database and the embedding model may be constructed by a remote server and pre-stored into a storage unit (e.g., the register) of the valve driving device to alleviate a computational load of the processor.

In some embodiments of the present disclosure, determining the failure probability distribution of the valve driving device through vector matching not only enables a rapid determination of the failure probability distribution, but also ensures an accuracy of the failure probability distribution to a certain extent.

In some embodiments, the valve driving device further includes a displacement sensor, and the displacement sensor may also be configured to collect a rotational feature of the positive power cam 13 and a rotational feature of the dedicated driving cam 14.

The rotational feature refers to a feature related to the rotation of the positive power cam 13 and the dedicated driving cam 14. In some embodiments, the rotational feature at least includes a rotation amount at each moment. The rotation amount at each moment refers to an incremental amount of rotation angle at a current moment compared to a previous moment.

In some embodiments, the rotational feature of the positivity power cam 13 may be obtained by a displacement sensor provided on and/or around the positive power cam 13. In some embodiments, the rotational feature of the dedicated driving cam 14 may be obtained by a displacement sensor provided on and/or around the dedicated driving cam 14.

In some embodiments, the processor is further configured to determine the failure probability distribution of the valve driving device based on the sound data collected by the sound sensor and a device state set corresponding to sound signals for each short time interval in the sound data. The device state set at least includes a current angle of the positive power cam 13 and a current angle of the dedicated driving cam 14. The current angle of the positive power cam 13 and the current angle of the dedicated driving cam 14 may be determined based on rotational features of the positive power cam 13 and rotational features of the dedicated driving cam 14 at one or more historical moments.

The device state set may be used to reflect a current state of the valve driving device. In some embodiments, the processor may determine the current angle of the positive power cam 13 and the current angle of the dedicated driving cam 14 based on the rotational features of the positive power cam 13 and the rotational features of the dedicated driving cam 14 at one or more moments, and then determine the device state set of the valve driving device. Merely by way of example, the processor may calculate the rotation amount of the positive power cam 13 and the rotation amount of the dedicated driving cam 14 at each moment in each short time interval, determine a sum of the rotation amount of the positive power cam 13 and a sum of the rotation amount of the dedicated driving cam 14, respectively, and then obtain the current angle of the positive power cam 13 and the current angle of the dedicated driving cam 14 by considering an angle (e.g., 0°) corresponding to a standard state, thereby obtaining a device state set corresponding to a sound signal for each short time interval in the sound data.

In some embodiments, based on the sound data collected by the sound sensor and the device state set corresponding to the sound signal for each short time interval in the sound data, the processor may determine the failure probability distribution of the valve driving device in a plurality of manners. For example, the processor may determine the failure probability distribution of the valve driving device through vector matching.

In some embodiments, based on the sound data collected by the sound sensor and the device state set corresponding to the sound signal for each short time interval in the sound data, the processor may determine the failure probability distribution of the valve driving device device through a failure probability determination model.

The failure probability determination model refers to a model used to determine the failure probability distribution of the valve driving device. In some embodiments, the failure probability determination model may be a machine learning model. For example, the failure probability determination model may include one or any combination of a convolutional neural network (CNN) model, a deep neural networks (DNN) model, another customized model, or the like.

In some embodiments, the failure probability determination model may include an embedding layer and a determining layer.

The embedding layer may be used to perform an embedding process on the sound data and the device state set corresponding to the sound signal for each short time interval in the sound data to determine a second embedding vector. In some embodiments, an input of the embedding layer may include the sound data and the device state set corresponding to the sound signal for each short time interval in the sound data, and an output of the embedding layer may include the second embedding vector. In some embodiments, the embedding layer may be a machine learning model, such as the CNN model, etc.

The determining layer may be used to analyze the second embedding vector to determine the failure probability distribution of the valve driving device. In some embodiments, an input of the determining layer may include the second embedding vector, and an output of the determining layer may include the failure probability distribution of the valve driving device. In some embodiments, the determining layer may be a machine learning model, such as the DNN model, etc.

In some embodiments, the failure probability determination model may be obtained by joint training of the embedding layer and the determining layer.

In some embodiments, the processor may train an initial embedding layer and an initial determining layer based on a large count of second training samples with second labels. A second training sample may include sample sound data and a sample device state set corresponding to a sound signal for each short time interval in sound data. The second label may include an actual failure probability distribution of the valve driving device corresponding to the second training sample. The second training sample may be determined based on historical data, and the second label may be determined based on manual labeling, etc.

Merely by way of example, a training process includes inputting the sample sound data and the sample device state set corresponding to the sound signal for each short time interval in the sound data into the initial embedding layer, obtaining the second embedding vector output from the initial embedding layer, inputting the second embedding vector output from the initial embedding layer into the initial determining layer, and obtaining the failure probability distribution of the valve driving device output from the initial determining layer, constructing a loss function based on the second label and the failure probability distribution of the valve driving device output from the initial determination layer, and synchronously updating parameters of the initial embedding layer and the initial determining layer. A trained embedding layer and a trained determining layer are obtained through parameter updating.

In some embodiments of the present disclosure, a fast and accurate determination of the failure probability distribution of the valve driving device may be realized through a trained failure probability determination model. At the same time, a joint training manner is used to train the failure probability determination model, which may effectively improve a training speed of the model. In addition, determining the failure probability distribution of the valve driving device based on the sound data and the device state set corresponding to the sound signal for each short time interval in the sound data may be more useful for clarifying a failure type. For example, a time for the positive power cam 13 to rotate one circle is 4t, a moment when the main lifting cam 13-1 of the positive power cam 13 is located at an uppermost point is t1, oil in the oil circuit is unloaded, and the driving valve 17 and the non-driving valve 18 realize positive power lift downwardly, if an abnormal sound is generated, a problem with the positive power cam 13 or an oil unloading circuit may occur, and a failure type (e.g., if a sudden abnormal sound that has never been heard before occurs, a foreign object may exist in the oil circuit or the valve, etc.) may be further determined by comparing the abnormal sound with the sound data of the positive power cam 13 or the oil circuit.

The beneficial effects provided by the embodiments of the present disclosure include but are not limited to: (1) by fixing the driver of the valve driving device on the rocker arm shaft, the engine power consumption and no motion wear caused by no motion friction between the driver and the rocker arm shaft may be achieved, and the dedicated driving cam may be separated from the main piston when the driver is not in operation, thereby effectively reducing wear between the dedicated driving cam and the main piston and noise of the engine, reducing friction loss, and improving a utilization rate of output power of the engine. When the driver is in operation, the dedicated driving cam automatically adjusts the driving valve through a hydraulic gap, and the driving lift is not affected by an initial gap setting, which is stable and consistent, and simple to use and maintain. Furthermore, the driving oil circuit is automatically drained once per revolution of the positive power cam, thus, a circulating flow of oil may not cause accumulation of impurities when the oil is too dirty, which improves working stability and reliability; (2) by setting up the pre-warning module, the pressure sensor, and the processor, monitoring and pre-warning of each elastic force of each elastic part may be realized, so as to detect and solve problems in time, which is conducive to improving the stability and reliability of the valve driving device; (3) by considering the cumulative usage intensity of each elastic part, the predetermined threshold of each elastic part is appropriately adjusted, which is conducive to improving the rationality of the pre-warning; (4) by determining the predetermined threshold of each elastic part based on the current deformation feature of each elastic part, the accuracy of the predetermined threshold may be improved, thus, improving the accuracy of the pre-warning; (5) based on the trained failure probability determination model, the failure probability distribution of the valve driving device may be determined more quickly and accurately. At the same time, the joint training manner is used to train the failure probability determination model, which may effectively improve the training speed of the model; (6) by determining the failure probability distribution of the valve driving device based on the sound data and the device state set corresponding to the sound signal for each short time interval in the sound data, the failure type may be clarified.

It should be noted that different embodiments may provide different beneficial effects, and in different embodiments, the beneficial effects that may be produced may be any one or a combination of any one or more of the beneficial effects mentioned above, or any other beneficial effect that may be obtained.

Having thus described the basic concepts, it may be rather apparent to those skilled in the art after reading this detailed disclosure that the foregoing detailed disclosure is intended to be presented by way of example only and is not limiting. Although not explicitly stated here, those skilled in the art may make various modifications, improvements, and amendments to the present disclosure. These alterations, improvements, and modifications are intended to be suggested by this disclosure and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure, or feature described in connection with the embodiment is included in at least one embodiment of the present disclosure. Therefore, it is emphasized and should be appreciated that two or more references to "an embodiment" or "one embodiment" or "an alternative embodiment" in various portions of the present disclosure are not necessarily all referring to the same embodiment. In addition, some features, structures, or characteristics of one or more embodiments in the present disclosure may be properly combined.

Furthermore, the recited order of processing elements or sequences, or the use of numbers, letters, or other designations therefore, is not intended to limit the claimed processes and methods to any order except as may be specified in the claims. Although the above disclosure discusses some embodiments of the invention currently considered useful by various examples, it should be understood that such details are for illustrative purposes only, and the additional claims are not limited to the disclosed embodiments. Instead, the claims are intended to cover all combinations of corrections and equivalents consistent with the substance and scope of the embodiments of the invention. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. However, this disclosure does not mean that object of the present disclosure requires more features than the features mentioned in the claims. Rather, claimed subject matter may lie in less than all features of a single foregoing disclosed embodiment.

Each of the patents, patent applications, publications of patent applications, and other material, such as articles, books, specifications, publications, documents, things, and/or the like, referenced herein is hereby incorporated herein by this reference in its entirety for all purposes. History application documents that are inconsistent or conflictive with the contents of the present disclosure are excluded, as well as documents (currently or subsequently appended to the present specification) limiting the broadest scope of the claims of the present disclosure. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the present disclosure disclosed herein are illustrative of the principles of the embodiments of the present disclosure. Other modifications that may be employed may be within the scope of the present disclosure. Thus, by way of example, but not of limitation, alternative configurations of the embodiments of the present disclosure may be utilized in accordance with the teachings herein. Accordingly, embodiments of the present disclosure are not limited to that precisely as shown and described.

What is claimed is:

1. A driving device for a composite engine valve of a dedicated driving cam, comprising:

a dedicated driving cam configured to be located on a side of an engine positive power cam, the dedicated driving cam including a base circular portion and a driving lift boss located on the base circular portion;

a valve bridge including an auxiliary piston slidably mounted in an auxiliary piston hole, a driving valve being connected to the auxiliary piston;

a driver configured to be fixedly mounted on a rocker arm shaft, the driver including a main piston cooperating with the dedicated driving cam, and the main piston slidingly mounted in a main piston hole; and a driving oil circuit configured to be intermittently in communication with the main piston hole and the auxiliary piston hole through a closure and disconnection of the driving oil circuit, the driving oil circuit being in communication with an oil supply circuit through a locating pressure control unit, wherein under a state that an engine positive power rocker arm does not drive a displacement of the valve bridge, the drive oil circuit is closed and the main piston hole is in communication with the auxiliary piston hole, under a state that the oil supply circuit supplies oil to the driving oil circuit, when the dedicated driving cam is rotated to the base circular portion to be in a sliding or rolling fit with the main piston, the main piston extends under a hydraulic action of the driving oil circuit to be contacted with the base circular portion, when the dedicated driving cam is rotated to the driving lift boss to be in a sliding or rolling fit with the main piston, the locating pressure control unit is configured to disconnect the driving oil circuit and the oil supply circuit to form a hydraulic linkage between the main piston and the auxiliary piston, such that the driving lift cam is able to drive a displacement of the driving valve connected to the auxiliary piston through the main piston, under a state that the positive power rocker arm drives the displacement of the valve bridge, the driving oil circuit is disconnected under the displacement of the valve bridge, the hydraulic linkage between the main piston and the auxiliary piston is released, the oil is drained from the auxiliary piston hole, and the auxiliary piston is reset within the valve bridge.

2. The device of claim 1, wherein the driver is provided with a main elastic element configured to drive the main piston to be retracted when pressure is released within the driving oil circuit.

3. The device of claim 1, wherein the oil supply circuit supplies the oil to the driving oil circuit in a unidirectional direction through the locating pressure control unit.

4. The device of claim 3, wherein the driver is provided with a shaft hole matching with the rocker arm shaft, the rocker arm shaft passes through the shaft hole, and the driver is fixedly connected to the rocker arm shaft through the locating pressure control unit.

5. The device of claim 4, wherein the locating control pressure unit includes a locating screw and a one-way assembly, the locating screw including an oil chamber and an oil inlet channel in communication with the oil chamber, and the oil supply circuit being provided on the rocker arm shaft; and the locating screw is threadedly connected to the driver to fix the driver on the rocker arm shaft, the oil chamber remaining in communication with the driving oil circuit, the oil supply circuit being in communication with the oil inlet channel, the one-way assembly being provided on the locating screw to make the oil inlet channel unidirectionally connected to the oil chamber.

6. The device of claim 5, wherein the rocker arm shaft is provided with a locating surface matching with the locating screw, and an end surface of an inner end of the locating screw is in contact with the locating surface.

7. The device of claim 5, wherein the one-way assembly includes an elastic element and a one-way ball, an end of the elastic element abutting against an inner wall of the oil chamber and another end of the elastic element abutting against a communication position between the oil inlet channel and the oil chamber.

8. The device of claim 5, wherein the driving oil circuit includes a main piston oil channel, an auxiliary piston oil channel, an inner oil channel, and an oil drain channel, the main piston oil channel and the auxiliary piston oil channel being provided in the driver, an end of the main piston oil channel being in communication with the main piston hole, another end of the main piston oil channel being in communication with the oil chamber, an end of the auxiliary piston oil channel being in communication with the oil chamber and another end of the auxiliary piston oil channel being in communication with the inner oil channel, the oil drain channel being in communication with the auxiliary piston hole, an elephant foot adjusting bolt that is a position adjustable configuration being provided on the driver, and the inner oil channel passing through the elephant foot adjusting bolt;

when the positive power rocker arm does not drive the displacement of the valve bridge, the elephant foot adjusting bolt is in contact with the valve bridge, the inner oil channel is in communication with the oil drain channel, and the driving oil circuit is closed; and when the positive power rocker arm drives the displacement of the valve bridge, the elephant foot adjusting bolt is separated from the valve bridge, the inner oil channel is separated from the oil drain channel, and the driving oil circuit is disconnected.

9. The device of claim 8, wherein an auxiliary elastic element is provided between the auxiliary piston and the auxiliary piston hole, the auxiliary elastic element being configured to push the valve bridge closer to the driver.

* * * * *